US008746758B2

(12) United States Patent
Savant et al.

(10) Patent No.: US 8,746,758 B2
(45) Date of Patent: Jun. 10, 2014

(54) SECURITY HANDLE FOR VEHICLES

(75) Inventors: Fiorenzo Savant, Creteil Cedex (FR); Silvano Rossinelli, Creteil Cedex (FR)

(73) Assignee: VALEO S.p.A., Santena (TO) (IT)

( * ) Notice: Subject to any disclaimer, the term of this patent is extended or adjusted under 35 U.S.C. 154(b) by 917 days.

(21) Appl. No.: 12/677,310

(22) PCT Filed: Sep. 5, 2008

(86) PCT No.: PCT/EP2008/061800

§ 371 (c)(1),
(2), (4) Date: Sep. 10, 2010

(87) PCT Pub. No.: WO2009/034035

PCT Pub. Date: Mar. 19, 2009

(65) Prior Publication Data

US 2010/0325841 A1 Dec. 30, 2010

(30) Foreign Application Priority Data

Sep. 11, 2007 (IT) ..... MI2007A1748

(51) Int. Cl.
*E05B 3/00* (2006.01)

(52) U.S. Cl.
USPC ..... 292/336.3

(58) Field of Classification Search
CPC ..... E05B 85/16; E05B 63/0056; E05B 79/06; E05B 77/06; E04F 15/02
USPC ..... 292/336.3, DIG. 22, DIG. 53, DIG. 54, 292/DIG. 64
See application file for complete search history.

(56) References Cited

U.S. PATENT DOCUMENTS

| | | | | |
|---|---|---|---|---|
| 6,007,122 | A * | 12/1999 | Linder et al. | 292/336.3 |
| 6,173,535 | B1 * | 1/2001 | Deischl et al. | 49/503 |
| 6,709,033 | B2 * | 3/2004 | Jooss et al. | 292/336.3 |
| 7,070,216 | B2 * | 7/2006 | von zur Muehlen | 292/336.3 |
| 7,303,217 | B2 * | 12/2007 | Savant | 292/336.3 |
| 8,029,032 | B1 * | 10/2011 | Yang | 292/336.3 |
| 2003/0038486 | A1 * | 2/2003 | Nomura et al. | 292/336.3 |
| 2006/0038418 | A1 * | 2/2006 | Huizenga et al. | 292/336.3 |
| 2006/0049647 | A1 * | 3/2006 | von zur Muehlen | 292/336.3 |
| 2006/0163887 | A1 | 7/2006 | Savant | |

FOREIGN PATENT DOCUMENTS

| | | | |
|---|---|---|---|
| EP | 1 473 423 | A2 | 11/2004 |
| EP | 1 556 569 | | 7/2005 |
| EP | 1 593 802 | A1 | 11/2005 |
| EP | 1593802 | * | 11/2005 |
| EP | 1 635 016 | A2 | 3/2006 |
| FR | 2 876 135 | A1 | 4/2006 |
| WO | 2004/042177 | A1 | 5/2004 |

OTHER PUBLICATIONS

International Search Report from PCT/EP2008/061800 dated Dec. 17, 2008 (3 pages).

* cited by examiner

*Primary Examiner* — Carlos Lugo
*Assistant Examiner* — Nathan Cumar
(74) *Attorney, Agent, or Firm* — Osha Liang LLP

(57) ABSTRACT

Handle for vehicles, which comprises a lever (5) which is pivoted for rotating around a first axis (7) in a frame (1) and is mechanically connected to a rocker (11; 111) which rotates around a second axis (12) when the lever (5) rotates, wherein a counterweight (28; 128) is pivoted to the frame (1) and is mechanically connected to the lever (5) for balancing the lever (5) and rotating around a third axis (30) when the lever (5) rotates.

28 Claims, 6 Drawing Sheets

SECURITY HANDLE FOR VEHICLES

The present invention relates to a handle for vehicle doors, and in particular to a lever handle which can be employed for unlocking and simultaneously opening the door of a motor vehicle and is provided with a security device which prevents the accidental opening of this door in case of accident.

EP-A-1556569 discloses a vehicle handle, which comprises a lever which can rotate in a frame and is mechanically connected to a rocker which rotates when the lever rotates. A security inertial device comprises an inertial mass which is pivoted to the frame for rotating around an axis parallel to the rotation axis of the lever. In case of impact, the inertial mass rotates by overcoming the force of a spring, so that a stop member thereof intercepts the rocker, which in turn prevents the rotation of the lever caused by the impact. With this arrangement, a door provided with said known handle does not open accidentally in case of accident.

However, the levers of the handles of motor vehicles tend to be always heavier, since they are covered with metallized covers and/or include one or more electric and/or electronic devices, for example to recognize the user and anticipate his intention to open a door. Therefore, also the inertial mass must be always heavier, and thus more cumbersome, so as to anticipate the lever rotation.

Furthermore, for safety reasons, it is suitable that, unlike said known handle, the lever remains locked after an accident, so that it is necessary to increase the threshold of the acceleration tending to rotate the handle in case of accident, for example from 30 to 80 G. Therefore, the force of the elastic means keeping the lever in the rest position has to be further increased, which however causes a too strong opposition, thus uncomfortable during the use, when the user pulls the lever for opening the door.

It is therefore an object of the present invention to provide a handle which is free from said disadvantages. Said object is achieved with a handle whose main features are disclosed in the first claim, while other features are disclosed in the remaining claims.

Thanks to the particular counterweight which balances the weight of the lever, the handle according to the present invention allows to significantly reduce the weight, and thus the size, of the inertial mass of the security device, also when the lever is relatively heavy.

Furthermore, the counterweight also allows to decrease the force exerted by the elastic means for keeping the handle in the rest position, so that the opposition to the lever rotation is low when the user pulls the lever. Said elastic means preferably consists of a particular spring acting on the counterweight, which rotates with an angle smaller than the angle covered at the same time by the lever, so that said opposition is substantially constant, i.e. it does not significantly increase. With this arrangement, the comfort of the user opening a door is further improved.

Another advantage of the handle according to the present invention lies in its relatively small size, obtained thanks to the particular mutual arrangement of the rotation axes of the lever, the counterweight, the rocker and the inertial mass. A further size reduction is obtained by employing helical springs arranged along said axes as elastic means for the rotation of the lever and/or the inertial mass, as well as by connecting the counterweight to the lever through the rocker, preferably by means of a particular articulation.

The handle according to the present invention is preferably provided with a particular locking device which prevents the rotation of the lever after an accident, so as to improve the security.

A further advantage of the handle according to the present invention lies in the possibility of easily substituting the counterweight with other counterweights more or less heavy for balancing the lever weight in an optimal manner.

In a particular embodiment of the handle, the counterweight and/or the rocker are symmetric with respect to a longitudinal plane, so that the handle can be substantially symmetric for being employed on both sides of a vehicle, so as to reduce the manufacturing, storing and assembling costs. This particular embodiment of the handle further allows to use two cables for operating not only the lock of a door but also other mechanisms of the same.

Further advantages and features of the handle according to the present invention will become clear to those skilled in the art from the following detailed and non-limiting description of two embodiments thereof with reference to the attached drawings, wherein.

Figure 1:
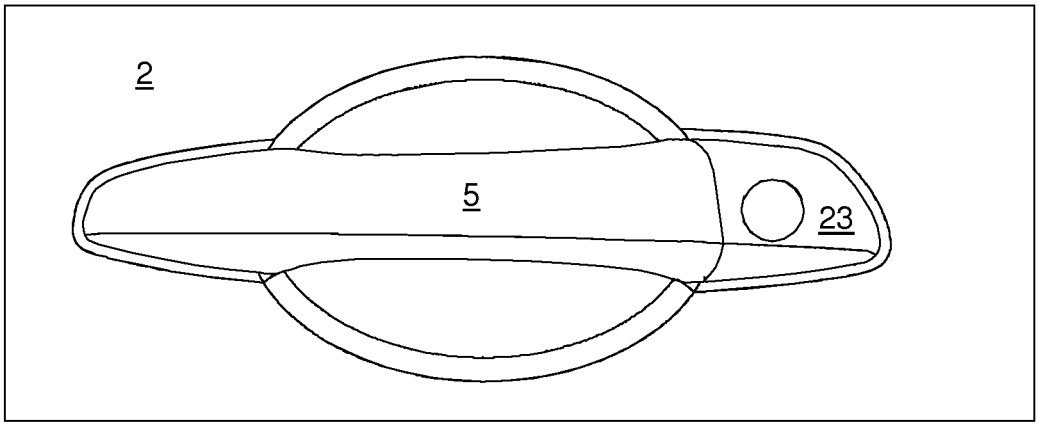
FIG. 1 shows a front view of the first embodiment of the handle in the rest position.
Figure 2:
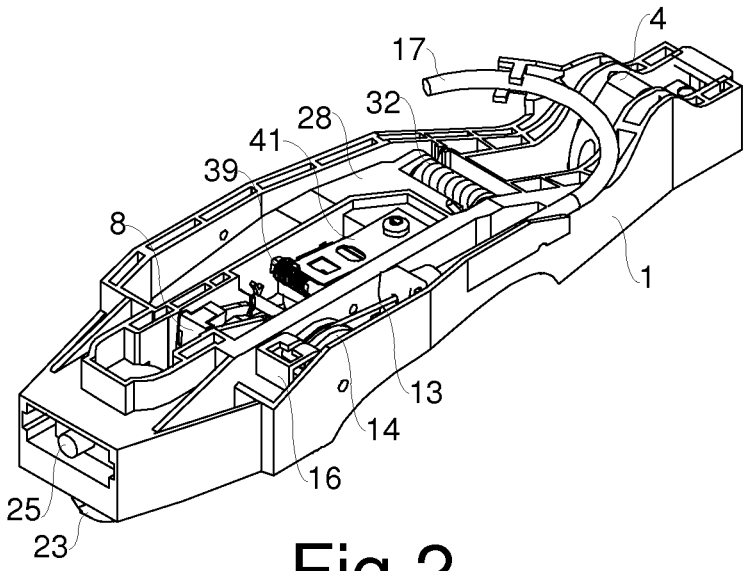
FIG. 2 shows a perspective view of the handle of FIG. 1.
Figure 3:
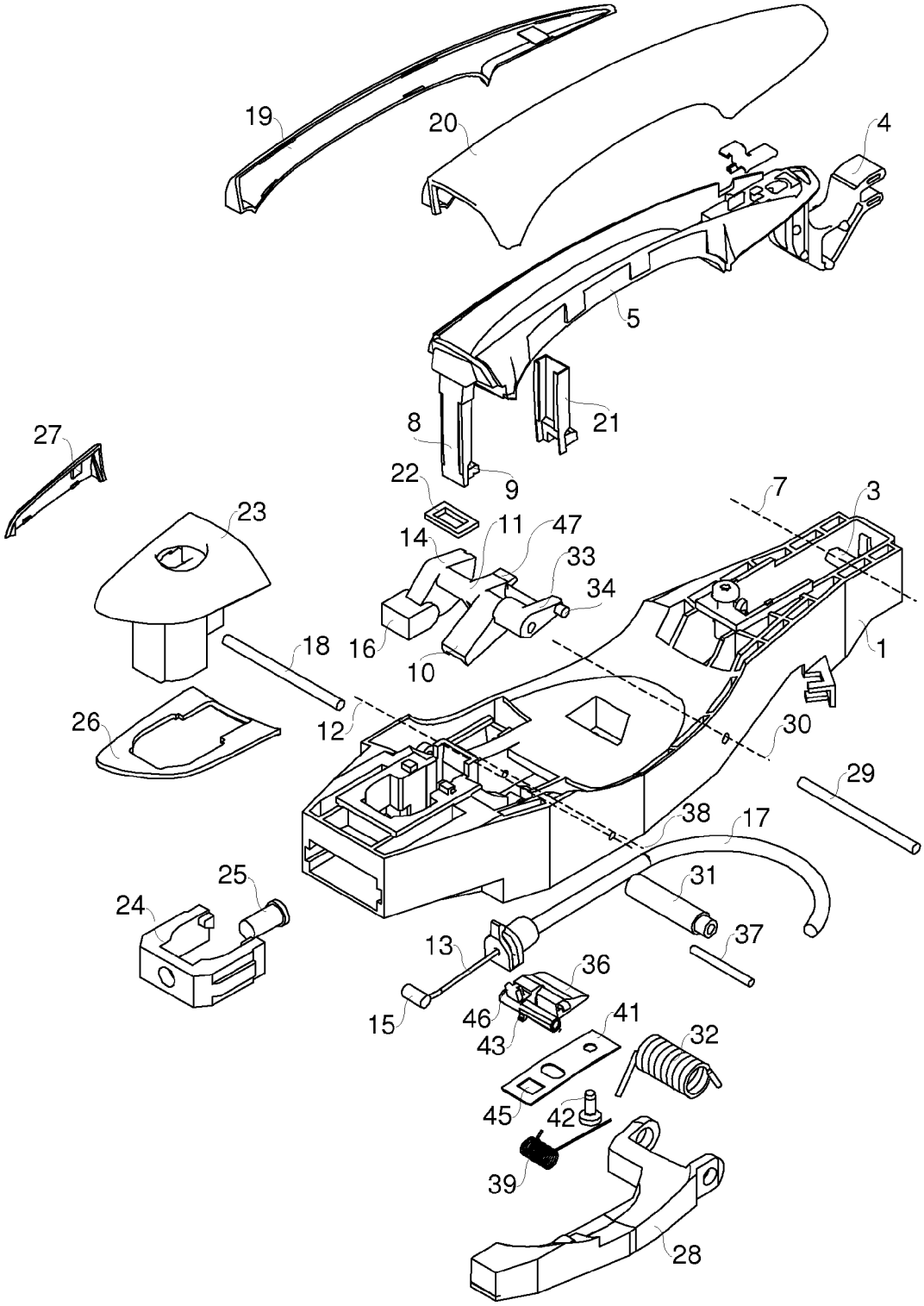
FIG. 3 shows an exploded view of the handle of FIG. 1.
Figure 4:
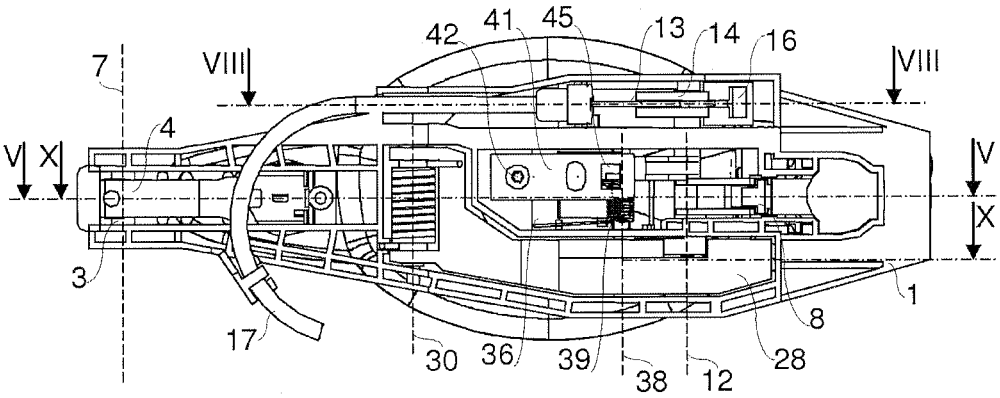
FIG. 4 shows a rear view of the handle of FIG. 1.
Figure 5:
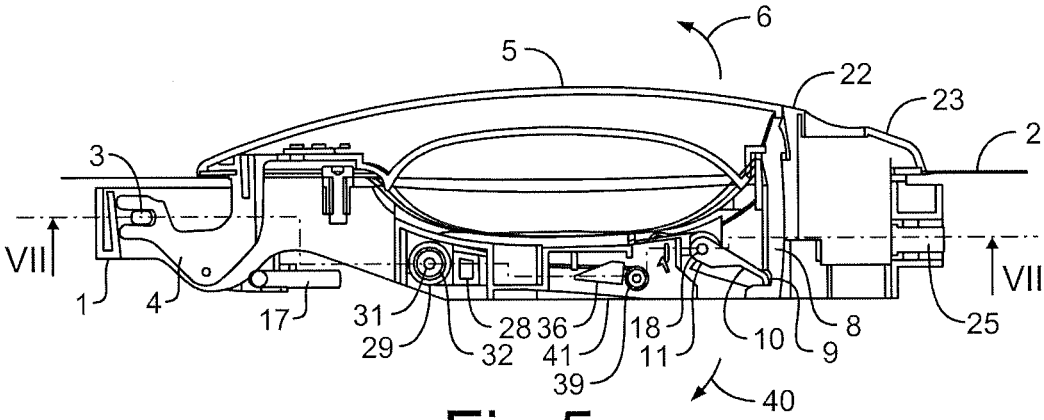
FIG. 5 shows section V-V of FIG. 4.

Referring to FIGS. 1 to 5, 7, 8 and 10, it is seen that the handle according to the first embodiment of the invention comprises in a known way a frame 1 suitable for being fixed for example behind the outer surface of a door 2 of a motor. Frame 1 is provided with a transversal pin 3 acting as a fulcrum, around which a shaped extension 4 arranged at one end of a lever 5 suitable for being pulled outwards in the direction of arrow 6 for opening door 2 can rotate. Lever 5 thus rotates around a first axis 7 generally parallel to the rotation axis of door 2. The other end of lever 5 is provided with an appendix 8 which protrudes into frame 1 and comprises a recess 9 in which a tongue 10 is engaged in a rotating manner. The latter protrudes from one side of a rocker 11 which can rotate in frame 1 around a second axis 12 substantially parallel to first axis 7. With this arrangement, lever 5 is mechanically connected to rocker 11, so that the latter rotates around second axis 12 when lever 5 is pulled. Rocker 11 is in turn connected to the unlocking mechanism (not shown in the figures) of door 2, so that the latter can be opened by further pulling lever 5. Said connection is for example carried out by means of a cable 13 which is pulled by an extension 14 of rocker 11 during the rotation of the latter. For this purpose, an end of cable 13 is provided with a head 15 housed in a seat 16 of extension 14. Frame 1 is also provided with a duct 17 in which cable 13 can slide. The rotation of rocker 11 in frame 1 is obtained by means of a pin 18 arranged along second axis 12. Lever 5 is preferably hollow for housing electric and/or electronic devices and is provided with one or more outer covers 19, 20. Appendix 8 is preferably provided with an antifriction slide 21. A gasket 22 is arranged around appendix 8. Frame 1 comprises a seat suitable for housing an auxiliary body 23 which can include a lock for locking or unlocking the door. Auxiliary body 23 is provided with a cap which is arranged beside lever 5 close to the end provided with appendix 8 and has a shape complementary to the shape of lever 5 for obtaining a continuous, tapered and rounded profile. Auxiliary body 23 is fastened to frame 1 by means of a bracket 24 locked by a screw 25. A gasket 26 is arranged between auxiliary body 23 and door 2. Auxiliary body 23 is hollow and is provided with an outer cover 27.

According to the invention, a counterweight 28 is pivoted to frame 1 by means of a pin 29 and is mechanically connected to lever 5 for rotating when also the latter rotates. Counterweight 28 rotates around a third axis 30 which is substantially parallel to first axis 7 and/or second axis 12 and is arranged between theses two axes. Elastic means act on counterweight 28 for urging lever 5 to the rest position. In particular, pin 29 is arranged coaxially in a hub 31 in turn arranged coaxially in a helical spring 32 suitable for rotating counterweight 28 so that lever 5 returns to the rest position after it has been pulled for opening door 2.

Counterweight 28 is mechanically connected to lever 5 through rocker 11 by means of an articulation 33 which protrudes from rocker 11 and is provided with a pin 34 which can rotate and slide in a groove 35 made in counterweight 28. In other embodiments of the invention, counterweight 28 can be connected directly to lever 5 by means of articulations or other mechanisms.

The handle according to the present invention suitably comprises a security inertial device suitable for preventing the rotation of lever 5, that is the opening of door 2, during an impact. In particular, this security inertial device comprises an inertial mass 36 pivoted to frame 1 by means of a pin 37 for rotating around a fourth axis 38 substantially parallel to first axis 7, second axis 12 and/or third axis 30. Fourth axis 38 is arranged between second axis 12 and third axis 30. Elastic means act on inertial mass 36 for opposing its rotation in a rotation is direction opposite to rotation direction 6 of lever 5 pulled outwards. In particular, pin 37 is arranged coaxially in a helical spring 39 urging inertial mass 36 in the same direction of rotation direction 6 of lever 5 pulled outwards.

Figure 6:
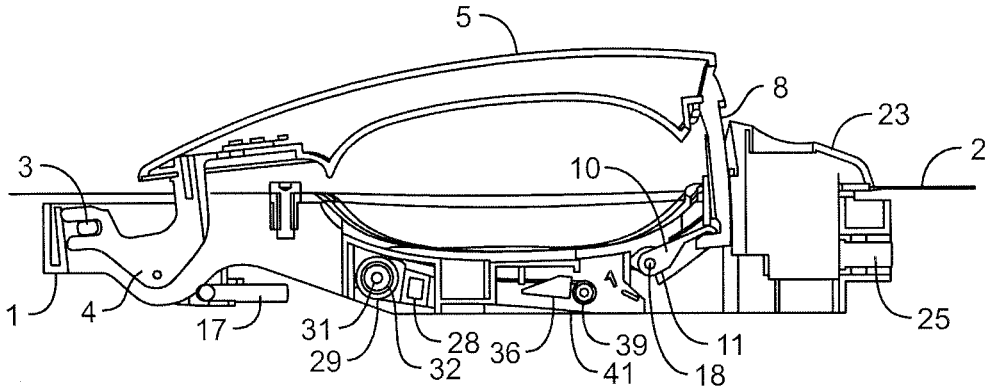
FIG. 6 shows the handle of FIG. 5 in the opening position.
Figure 7:
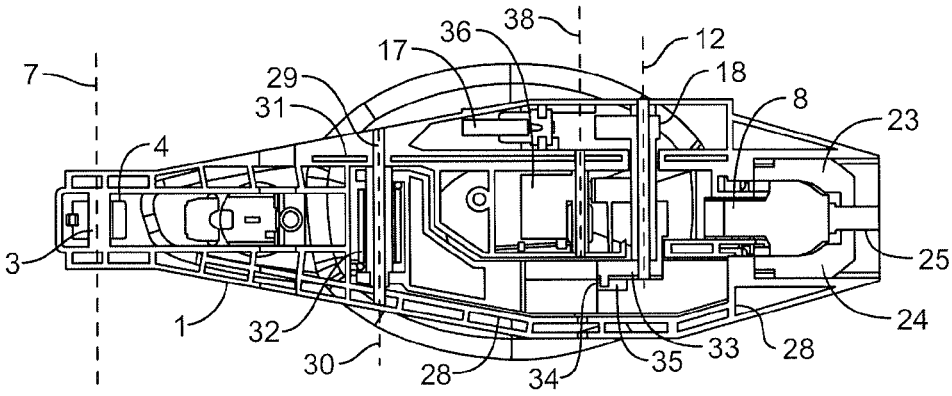
FIG. 7 shows section VII-VII of FIG. 5.
Figure 8:
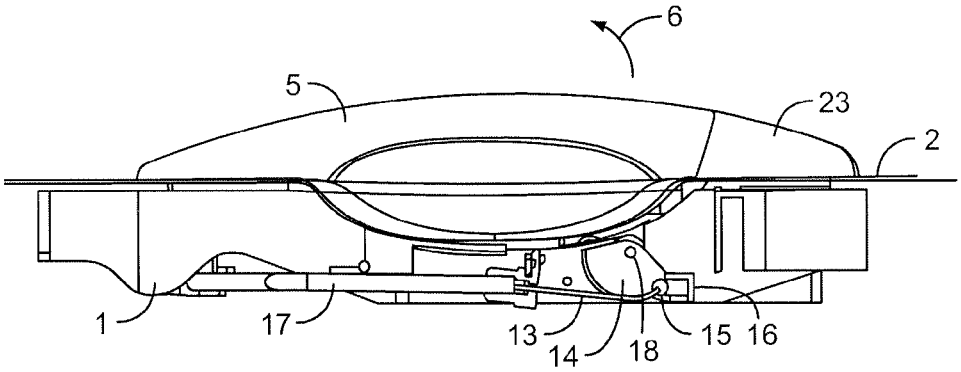
FIG. 8 shows section VIII-VIII of FIG. 4.
Figure 9:
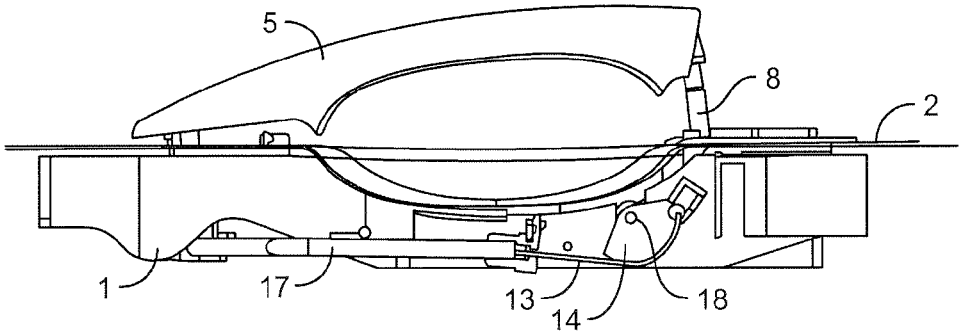
FIG. 9 shows the handle of FIG. 8 in the opening position.
Figure 10:
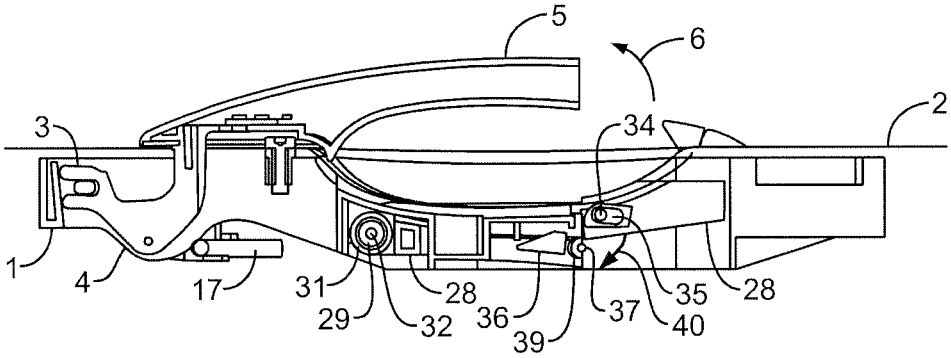
FIG. 10 shows section X-X of FIG. 4.
Figure 11:
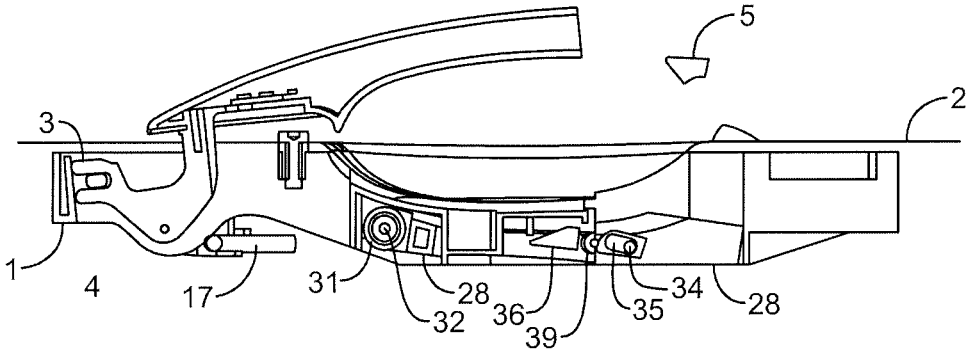
FIG. 11 shows the handle of FIG. 10 in the opening position.

Referring to FIGS. 6, 9 and 11, it is seen that articulation 33 protrudes from rocker 11 from the side opposite to tongue 10, so that when lever 5 is pulled outwards in the direction of arrow 6, rocker 11 rotates in the same direction, while counterweight 28 rotates in the opposite direction, that is in the direction of arrow 40, and vice versa. The angle covered during the rotation of counterweight 28 is preferably smaller than the angle covered at the same time by lever 5.

Figure 12:
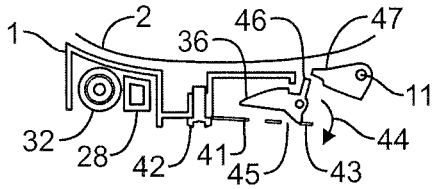
FIG. 12 shows a longitudinal section of the inertial device of the handle of FIG. 1 in the rest position.
Figure 13:
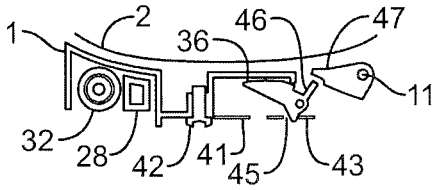
FIG. 13 shows the device of FIG. 12 after a collision.

Referring also to FIGS. 12 and 13, it is seen that the handle according to the present invention further comprises a locking device suitable for locking inertial mass 36 after its rotation caused by an impact. In particular, this locking device comprises a flexible plate 41 which is fixed to frame 1 by means of a screw 42 and is elastically bent by a tooth 43 of inertial mass 36 during the normal use of the handle. In case of impact, inertial mass 36 rotates in the direction of arrow 44 if it undergoes an acceleration suitable for overcoming the opposition of the elastic means, that is of helical spring 39. During this rotation, tooth 43 falls into an opening 45 made in flexible plate 41, so as to lock inertial mass 36 in an impact position in which a stop member 46 protruding from inertial mass 36 can intercept a protrusion 47 protruding from rocker 11 from the side opposite to tongue 10, so as to prevent the rotation of the latter, as well as the rotation of lever 5.

Figure 14:
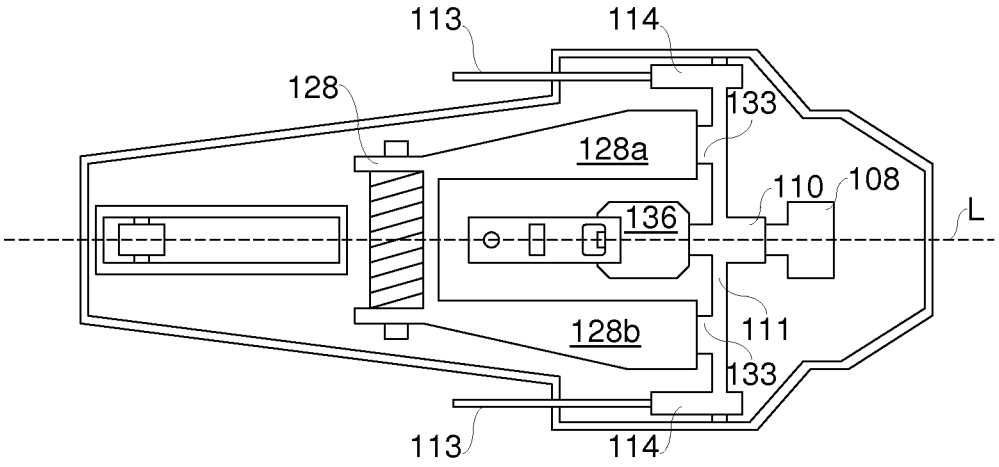
FIG. 14 shows a schematic rear view of the second embodiment of the handle.

Referring to FIG. 14, it is seen that the handle according to the second embodiment of the present invention is similar to the first embodiment, however counterweight 128 has a substantially symmetric shape with respect to a longitudinal plane L and comprises two arms 128*a*, 128*b* which are mechanically connected to two articulations 133 protruding from rocker 111. Inertial mass 136 is arranged between the two arms 128*a*, 128*b* of counterweight 128. Articulations 133 are arranged between two extensions 114 of rocker 111 for pulling one or more cables 113. Tongue 110 of rocker 111 is mechanically connected to appendix 108 and is arranged between articulations 133. Also rocker 111 has a substantially symmetric shape with respect to plane L.

Further modifications and/or additions may be made by those skilled in the art to the hereinabove disclosed and illustrated embodiments while remaining within the scope of the following claims.

The invention claimed is:

1. A handle for vehicles, comprising:

a lever which is pivoted for rotating around a first axis in a frame and is mechanically connected to a rocker so that said rocker rotates around a second axis when the lever rotates;

a counterweight pivoted to the frame and mechanically connected to the lever for balancing the lever, wherein the counterweight rotates around a third axis when the lever rotates; and a security inertial device suitable for preventing the rotation of the lever during an impact, the security inertial device comprising an inertial mass which is pivoted to the frame for rotating around a fourth axis and is provided with a stop member for intercepting the rocker.

2. The handle according to claim 1, wherein the third axis is substantially parallel to one of the first axis and the second axis.

3. The handle according to claim 1, wherein the third axis is arranged between the first axis and the second axis.

4. The handle according to claim 1, wherein elastic means act on the counterweight to urge the lever to a rest position.

5. The handle according to claim 4, wherein said elastic means comprise a helical spring arranged along the third axis.

6. The handle according to claim 1, wherein the counterweight is mechanically connected to the lever through the rocker.

7. The handle according to claim 6, wherein the counterweight is mechanically connected to the lever by means of an articulation protruding from the rocker.

8. The handle according to claim 7, wherein said articulation is provided with a pin which can rotate and slide in a groove made in the counterweight.

9. The handle according to claim 7, wherein the articulation protrudes from the rocker from a side opposite to a tongue suitable for mechanically connecting the rocker to the lever.

10. The handle according to claim 1, wherein when the lever rotates, the rocker rotates in a same direction.

11. The handle according to claim 1, wherein when the lever rotates, the counterweight rotates in the opposite direction.

12. The handle according to claim 1, wherein an angle covered during the rotation of the counterweight is smaller than an angle covered at the same time by the lever.

13. The handle according to claim 1, wherein the stop member is suitable for intercepting a protuberance protruding from the rocker from the side opposite to a tongue suitable for mechanically connecting the rocker to the lever.

14. The handle according to claim 1, wherein the fourth axis is substantially parallel to one of the first axis, the second axis and the third axis.

15. The handle according to claim 1, wherein the fourth axis is arranged between the second axis and the third axis.

16. The handle according to claim 1, wherein elastic means act on the inertial mass for opposing rotation of the inertial mass.

17. The handle according to claim 16, wherein said elastic means comprise a helical spring arranged along the fourth axis.

18. The handle according to claim 17, wherein said helical spring urges the inertial mass in the same direction of rotation of the lever starting from a rest position.

19. The handle according claim 1, further comprising a locking device suitable for preventing the rotation of the lever after an impact.

20. The handle according to claim 19, wherein the locking device locks the inertial mass after a rotation thereof.

21. The handle according to claim 20, wherein the locking device comprises a flexible plate which is fixed to the frame and is elastically bent by a tooth of the inertial mass.

22. The handle according to claim 21, wherein the flexible plate is provided with an opening suitable for intercepting the tooth of the inertial mass during the rotation of the latter.

23. The handle according to claim 1, wherein the counterweight has a substantially symmetric shape with respect to a longitudinal plane (L).

24. The handle according to claim 23, wherein the counterweight comprises two arms which are mechanically connected to the rocker.

25. The handle according to claim 24, wherein the inertial mass is arranged between the two arms of the counterweight.

26. The handle according to claim 24, wherein the two arms of the counterweight are mechanically connected to the rocker by means of two articulations.

27. The handle according to claim 26, wherein the articulations are arranged between two extensions of the rocker for pulling one or more cables.

28. The handle according to claim 26, wherein a tongue suitable for mechanically connecting the rocker to the lever is arranged between the articulations.

* * * * *